US006739281B1

(12) United States Patent
Grimes

(10) Patent No.: US 6,739,281 B1
(45) Date of Patent: May 25, 2004

(54) RECONFIGURABLE BOAT DECK

(76) Inventor: J. Scott Grimes, 6807 Hardscrabble Ct., Wilmington, NC (US) 28409

( * ) Notice: Subject to any disclaimer, the term of this patent is extended or adjusted under 35 U.S.C. 154(b) by 0 days.

(21) Appl. No.: 10/404,954

(22) Filed: Mar. 31, 2003

(51) Int. Cl.[7] ..... B63B 17/00
(52) U.S. Cl. ..... 114/364
(58) Field of Search ..... 114/343, 357, 114/363, 364, 77 R, 85; 244/137.1, 118.6

(56) References Cited

U.S. PATENT DOCUMENTS 3,142,461 A * 7/1964 Naylor ..... 244/137.1
3,473,176 A 10/1969 Taylor
3,486,204 A * 12/1969 Hurtner et al. ..... 224/137.1
3,839,757 A 10/1974 Grimes
4,476,798 A * 10/1984 Backus ..... 114/77 R
4,503,799 A * 3/1985 Masters ..... 114/363
4,579,073 A 4/1986 Sadler et al.
4,763,598 A 8/1988 Spencer
5,320,060 A * 6/1994 Gunter ..... 114/363
5,383,630 A * 1/1995 Flatten ..... 244/118.6
5,492,386 A 2/1996 Callum
5,997,069 A 12/1999 Coffey et al.
6,065,422 A 5/2000 Davidson et al.
6,223,677 B1 5/2001 Hall et al.
6,283,059 B1 9/2001 Scully, Jr.
6,302,358 B1 * 10/2001 Emsters et al. ..... 244/137.1
6,352,047 B1 3/2002 Bogniard

* cited by examiner

*Primary Examiner*—S. Joseph Morano
*Assistant Examiner*—Lars A. Olson
(74) *Attorney, Agent, or Firm*—MacCord Mason PLLC

(57) ABSTRACT

An adaptable, multi-purpose boat having a longitudinal axis and a transverse axis, the boat being made up of a generally planar boat deck having middle, fore, aft, port and starboard sections. A plurality of first mating elements disposed in a first predetermined pattern on the boat deck, and a plurality of deck components each having at least one second mating element attached to at least one of the first mating elements, whereby the deck components are removably attachable to the boat deck in different configurations. The boat further includes a plurality of utility attachment points disposed on the boat deck in a second predetermined pattern.

20 Claims, 6 Drawing Sheets

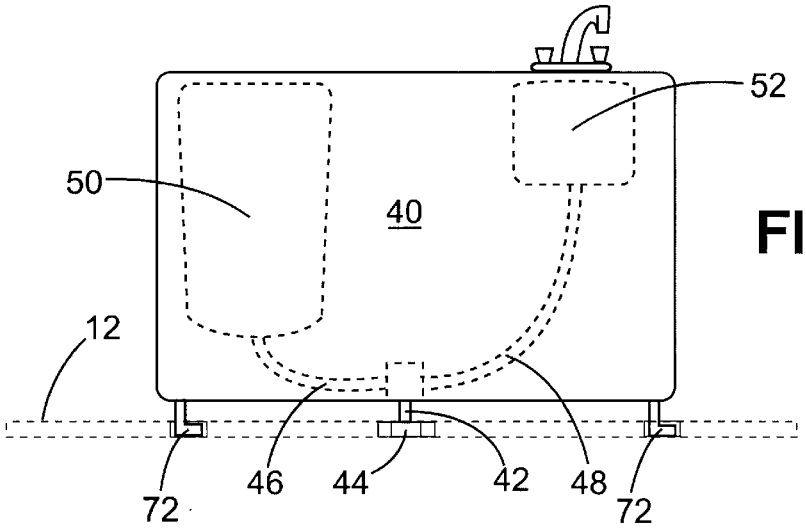
FIG. 2
FIG. 3
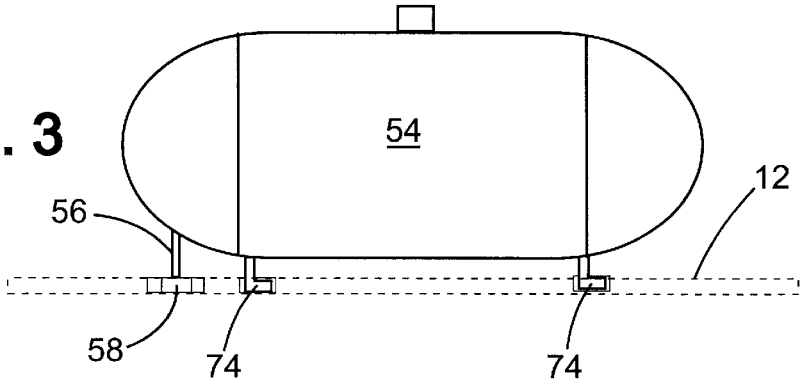
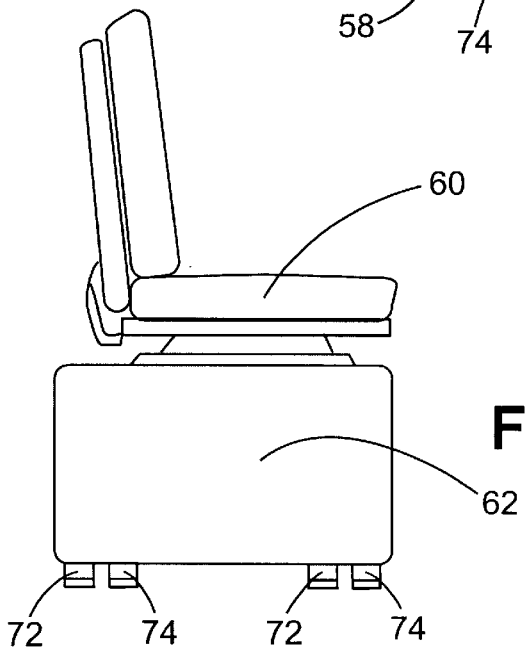
FIG. 4

RECONFIGURABLE BOAT DECK

BACKGROUND OF THE INVENTION (1) Field of the Invention

The present invention relates to boats such as recreation and fishing boats. In particular, the present invention relates to a boat having a deck that can be repeatedly reconfigured aftermarket to accommodate different tasks.

(2) Description of the Prior Art

Boat decks are generally planar surfaces that are attached atop a boat's hull. Deck components such as steering consoles, pilot chairs, passenger seats, storage boxes and the like are items that are typically permanently fixed to a boat deck in a manufacturer's selected configurations. As such, a purchaser of a boat usually must select from a manufacturer's deck configuration offerings or have a boat deck custom configured. In either case, reconfiguring a boat deck aftermarket is not a simple or inexpensive task due to the permanent attachment of the deck components. This lack of aftermarket flexibility with regard to deck layout and configuration leaves a potential boat owner with a dilemma of having to compromise in selecting a boat that might serve some purpose but not others.

Some boaters attempt to deal with the lack of aftermarket flexibility by purchasing a boat having a boat deck configuration that meets a majority of their needs. Others attempt to solve this problem with the purchase of multiple boats with decks configured for specific needs. For example, a boater only interested in fishing might want to purchase a boat having a steering console mounted near the center of the boat's deck so that a hooked fish could be worked all the way around the sides of the boat without having to worry about fouling fishing line on the steering console. On the other hand, a boater only interested in waterskiing might prefer having the steering console of a ski boat fixed to the central starboard section of the ski boat's deck. However, a boater interested in both waterskiing and fishing would either have to compromise on the location of the steering console or would need to own two boats, one for each endeavor. What is needed is a boat that has a deck that can be repeatedly reconfigured aftermarket for various purposes.

SUMMARY OF THE INVENTION

The present invention is directed towards an adaptable multi-purpose boat having a boat deck that remains flexible in its configuration. The invention relates especially to a boat having deck components such as steering consoles and seats adapted to be removed from, added to, or relocated on the boat deck repeatable times by a boat owner.

Generally, the boat of the present invention comprises a generally planar boat deck having a longitudinal axis, a transverse axis along with middle, fore, aft, port and starboard sections. A plurality of like first mating elements is disposed in a first predetermined pattern on the boat deck. In addition, a plurality of deck components is removably attachable to the boat deck. Each deck component has at least one second mating element attachable to at least one of the first mating elements. Preferably, the first and second elements are key lockable. Also, for any given deck configuration the total number of first mating elements exceeds the number of second mating elements.

In a preferred embodiment, the predetermined pattern for the like first mating elements is a rectangular array covering the fore, middle and aft sections of the deck from the boat's port side to its starboard side. The array has columns and rows of like first mating elements aligned with the boat's longitudinal and transverse axes. Also, with this preferred embodiment, each deck component, whenever it is secured to the deck, has at least one second mating element attached to at least one of the first mating elements, wherein each of the first mating elements has a recess and each of the second mating elements has a projection insertable into the recess of the first mating elements.

The deck components can be, but are not limited to items such as seats, chairs, storage boxes, bait preparation stations and steering consoles. In the case of the present invention, deck components such as these can be considered aftermarket accessories.

Each deck component has a base for resting on the planar surface of the boat deck. In a preferred embodiment of the invention, most of the deck components have a base with dimensions that allow two or more attached second mating elements to be aligned and spaced to match predetermined multiples of the column and row spacing of the first mating elements. For the purpose of this disclosure, the predetermined spacing and alignment of two or more second mating elements attached to the base of a deck component is referred to as the footprint of the deck component.

Deck components such as steering consoles need access to electrical power and cabling that carries steering signals to servomotors that direct a rudder or thrust of a propeller. Moreover, a deck component such as a bait preparation station usually includes a live bait well and sink having drain lines. As such, these types of deck components need access to utility attachment points. These utility attachment points can include but are not limited to utility connectors for electrical power, signal cabling, and piping. The utility attachment points may be as simple as deck portals sized to accommodate standard marine electrical wiring, signal cabling and plumbing, or they can be deck panel inserts having connectors organized in groups for electrical, cabling and piping connections.

The present invention provides a plurality of utility attachment points disposed in a second predetermined pattern. In a preferred embodiment, the second predetermined pattern is an array covering the fore, middle and aft sections of the deck from the boat's port side to its starboard side. The array has columns and rows of utility attachment points aligned with the longitudinal and transverse axes of the boat deck. All of the utility attachment points may or may not be identical. In other words, some utility attachment points may only include an electrical power connection while others would include piping as well. Furthermore, an entire row or column of utility attachment points might be dedicated for a particular use. For example, a row of utility attachment points located in the aft section of a boat deck might be dedicated only to fuel line connections for an auxiliary fuel tank type deck component.

In use, any one of the aforementioned deck components can be secured to any location on the boat deck having first mating elements available to accept the footprint of the particular deck component. Before reconfiguring the boat deck layout for a particular task or purpose, a boater may need to remove some or all of the deck components from the boat deck to make deck space available.

Removal of a deck component begins with the disconnection of any and all of the deck component's electrical wiring, electronic cabling and piping connected to connectors belonging to one or more utility attachment points. Next, all of the second mating elements belonging to the deck component being removed are detached from their corresponding first elements. This allows the deck component to be entirely removed from the deck. Once the appropriate deck components are detached from the deck they can be repositioned or removed from the deck to make room for the addition deck components. In this way, a particular deck layout for a particular task can be realized.

In an example case, a boater might choose a deck configuration ideally suited for a fishing trip. The deck components chosen for the fishing trip might include a steering console, a fishing-chair, a bait preparation station and an auxiliary fuel tank. The boater might choose to secure the fishing chair to the fore section of the boat deck. The boater proceeds by carrying the fishing-chair to the fore section of the boat deck to align all of the second mating elements with a corresponding group of first mating elements disposed on the fore section of the boat deck. Once aligned, all of the chairs second mating elements are attached to the corresponding first elements, thus securing the fishing chair to the deck.

Next the boater may choose to secure the steering console to the middle section of the deck. The boater begins by positioning the steering console close to the location where the console is to be secured. This temporary position for the steering console should be such that any utility attachment points to be used are freely accessible.

At this point, the boater may wish to connect any electrical wiring and cabling leading from the steering console to appropriate connectors belonging to one or more of the utility attachment points. Once the appropriate connections are made, the console is secured to the deck by aligning and attaching the consoles second mating elements to corresponding first mating elements. On the other hand, the boater may choose to secure the console before making any utility connections.

Next, the boater may decide to secure an auxiliary fuel tank to the aft section of the boat deck. Similar to securing the steering console, the boater will place the auxiliary fuel tank on the boat's deck at a position that allows easy connection of the tank's fuel line to a fuel line connector belonging to a nearby utility attachment point. Once the fuel line is connected, aligning and attaching the tank's second mating elements to corresponding first mating elements will secure the auxiliary fuel tank to the boat's deck.

Subsequently, the boater may wish to secure the bait preparation station to the aft port section of the boat. The boater proceeds by carrying the bait preparation station to the aft port section of the boat deck to align all of the second mating elements with a corresponding group of first mating elements disposed on the aft port section of the boat deck. Once aligned, all of the station's second mating elements are attached to the group of corresponding first elements, thus securing the bait preparation station to the deck. The deck reconfiguration may be completed with the connection of one or more of the bait station's plumbing lines to one or more plumbing connectors belonging to one or more utility attachment points.

In another example, the boater may decide to convert the fishing boat of the previous example into a pleasure boat able to carry seated passengers. In this case, the reconfiguration process involves first removing the bait preparation station, fishing-chair, and auxiliary fuel tank. Once the deck is clear of these items, seats for the passengers and driver may be added and secured to the boat's deck in a manner similar to that described for securing fishing-chair in the previous example.

The boat of the present invention can also be configured to include accessory deck components. One such accessory deck component could be an optional console that is combinable with a steering console to create a single large console. The optional console would add additional panel space for marine instrumentation, etc.

These and other aspects of the present invention will become apparent to those skilled in the art after a reading of the following description of the preferred embodiment.

BRIEF DESCRIPTION OF THE DRAWINGS

FIG. 2 is a front side view of bait preparation station secured to the boat deck.

FIG. 3 is a backside view of an auxiliary fuel tank secured to the boat deck.

FIG. 4 is a side view of a fishing chair mounted atop a storage box.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
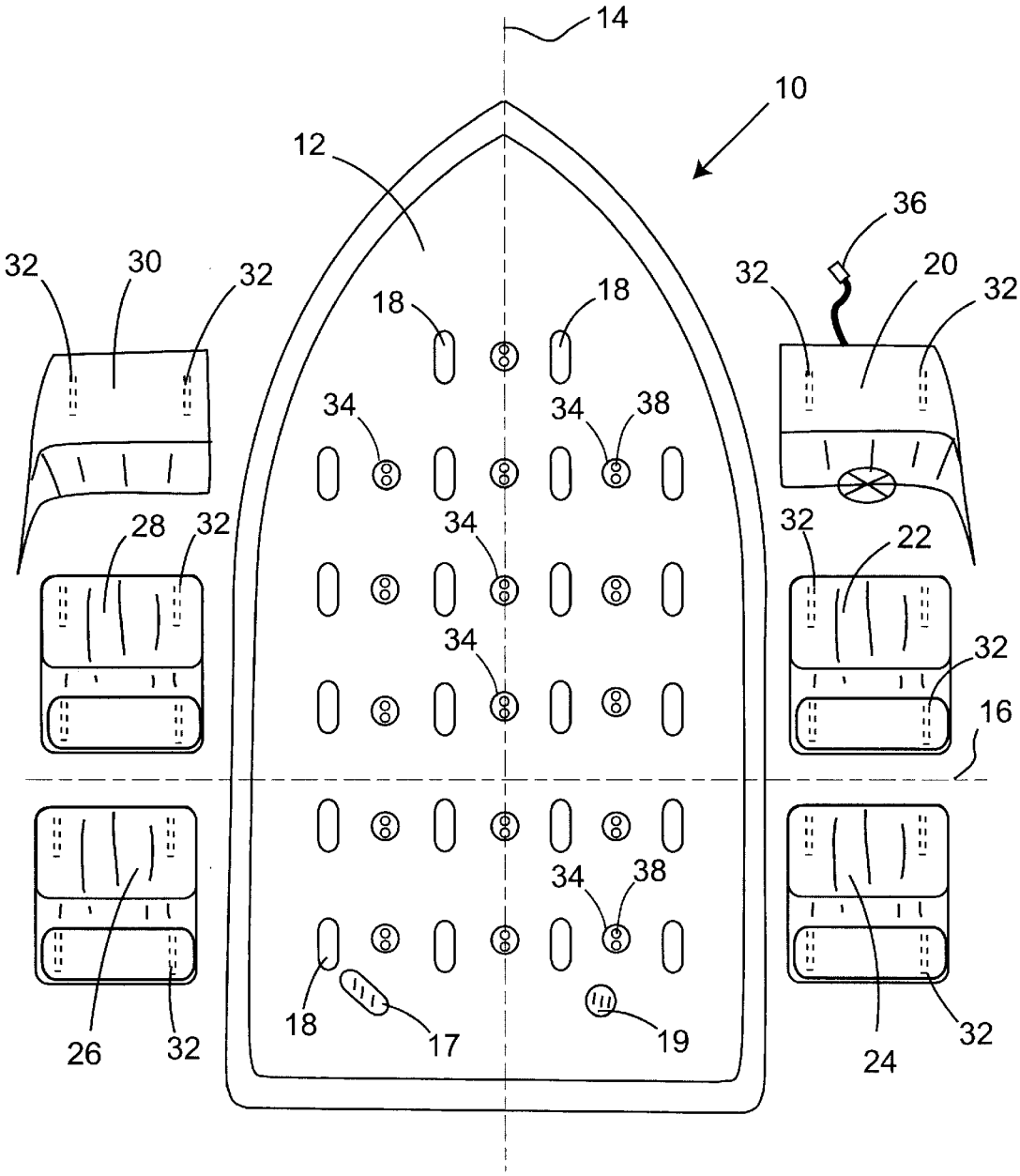
FIG. 1 is a top view of the boat of the present invention.

Referring to the drawings and first to FIG. 1, a boat 10 comprises a generally planar deck 12 having a longitudinal axis 14 and a transverse axis 16. A plurality of like first mating elements 18 is disposed in a first predetermined pattern on deck 12. Preferably, this first predetermined pattern is a rectangular array having columns aligned with longitudinal axis 14 and rows aligned with transverse axis 16. FIG. 1 shows a plurality of deck components 20 through 30 each having at least one second mating element 32 attachable to at least one of first mating elements 18. Covers can be placed over any unmated first mating elements. A first mating element cover 17 is shown resting on deck 12 in FIG. 1.

Deck 12 further includes a plurality of utility attachment points 34 disposed in a second predetermined pattern. Preferably, this second predetermined pattern is a rectangular array having columns aligned with longitudinal axis 14 and rows aligned with transverse axis 16. It is also preferred that utility attachment points 34 have connectors for standard marine wiring, control cables and piping. The type and number of connectors per utility attachment point need not be uniform. Lids can be placed over any unused utility access point. A utility lid 19 is shown resting on deck 12 in FIG. 1.

For example, one of the deck components is a steering console 20 having a first electrical connector 36 that is connectable to a second electrical connector 38 belonging to at least one of utility attachment points 34. In another example, a bait preparation station 40 (shown in FIG. 2) has at least one drainpipe 42 connectable to a drainpipe connector 44 belonging to at least one of utility attachment points 34. Drainpipe 42 can drain water from drain lines 46 and 48 coming from a live-bait-well 50 and a sink 52. In yet another example shown in FIG. 3, a deck component could be an auxiliary fuel tank 54 having a fuel line 56 connectable to a fuel line connector 58 belonging to at least one of utility attachment points 34. FIG. 4 depicts a fishing chair 60 mounted atop storage box 62.

Figure 5:
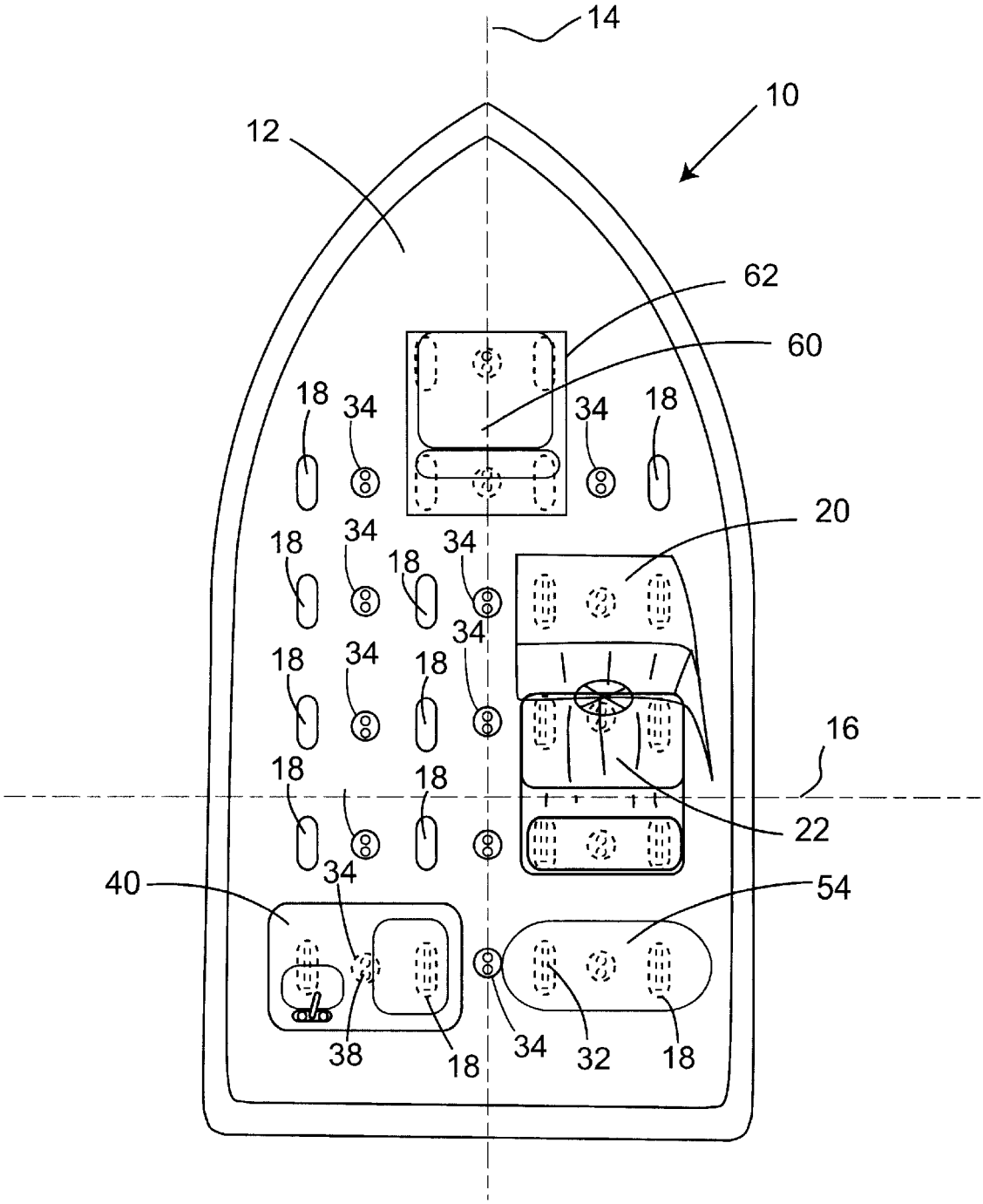
FIG. 5 is a top view of the boat configured as a fishing boat.
Figure 6:
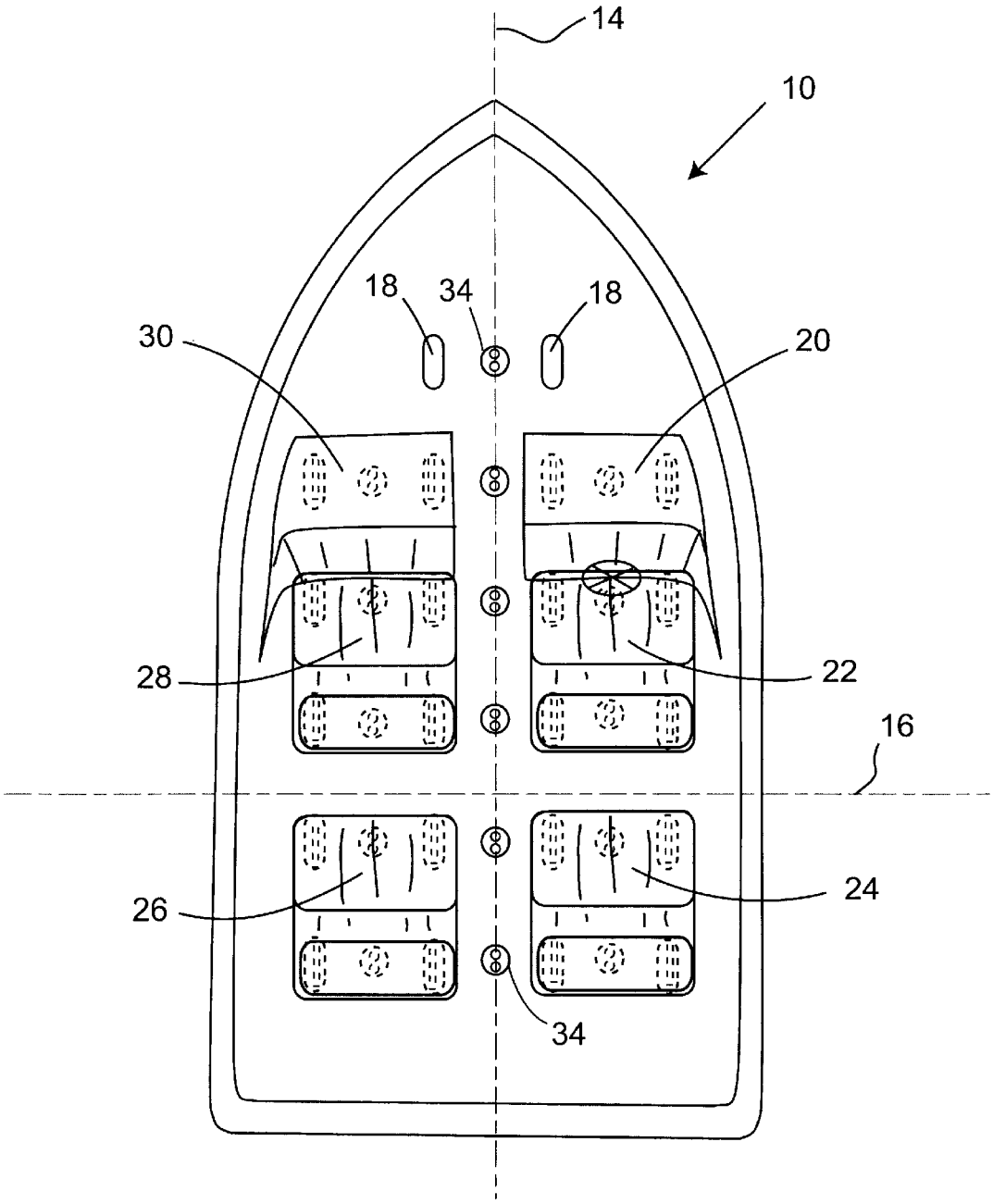
FIG. 6 is a top view of the boat configured as a passenger boat.

FIG. 5 shows boat 10 in a configuration suitable for a fishing trip. In this configuration, deck 12 includes a steering console 20, driver's seat 22, bait preparation station 40 and fishing chair 60 mounted atop storage box 62. FIG. 6 on the other hand, shows deck 10 reconfigured for a pleasure boat ride for a driver and three passengers. Drivers seat 22 is secured to deck 12 behind steering console 20. Passenger seat 24 faces forward and is aligned directly behind driver's seat 22. Passenger console 30 provides a windbreak for passengers seated in seats 28 and 26.

Figure 7:
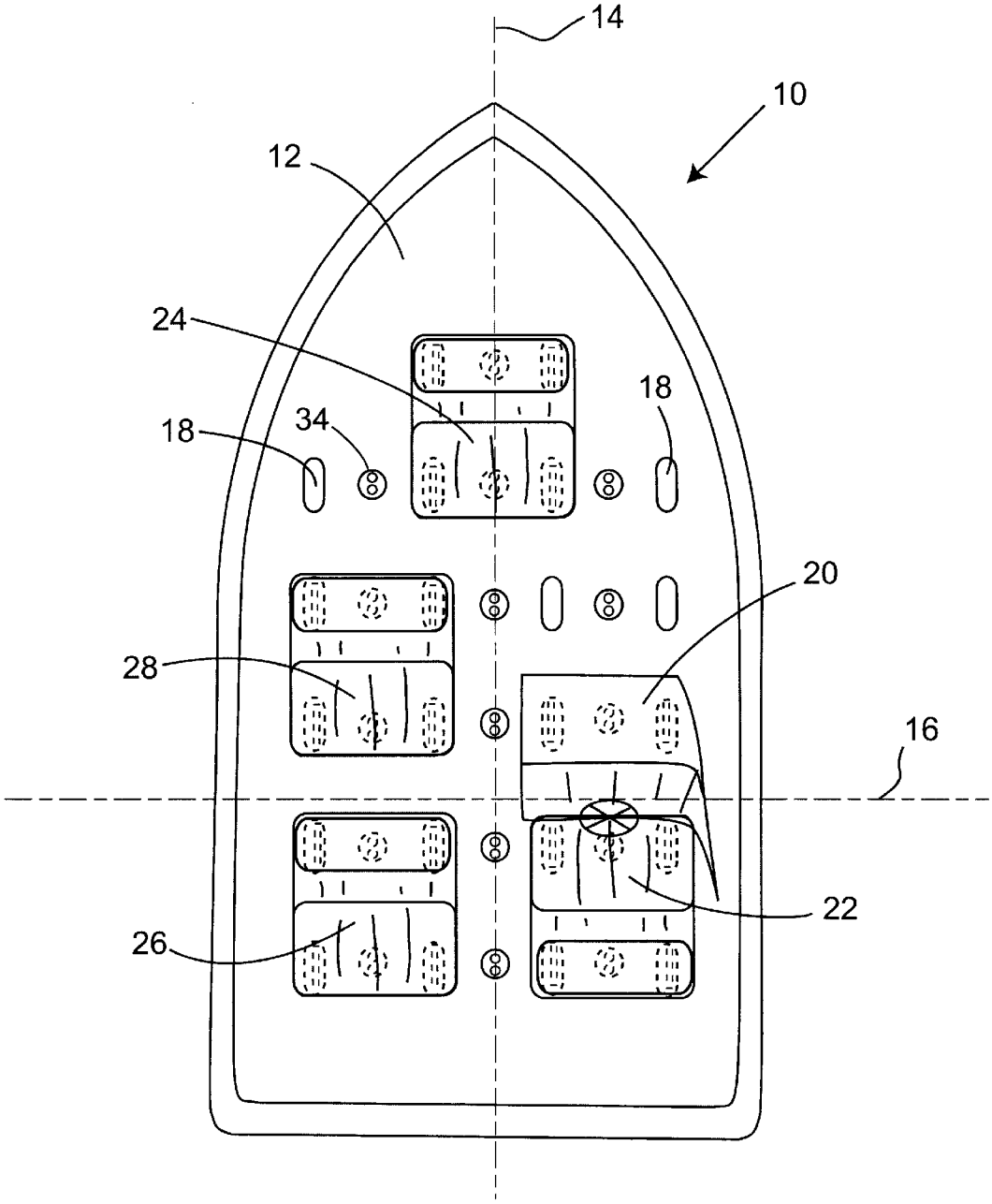
FIG. 7 is a top view of the boat in an alternate configuration for passengers.

FIG. 7 shows yet another deck configuration for boat 10. In this particular configuration, seat 24 is repositioned and secured to first mating elements 18 near the bow of boat 10. Driver's seat 22 and steering console 20 are repositioned rearward and seats 26 and 28 are repositioned on deck 12 so that they face rearward.

Figure 8:
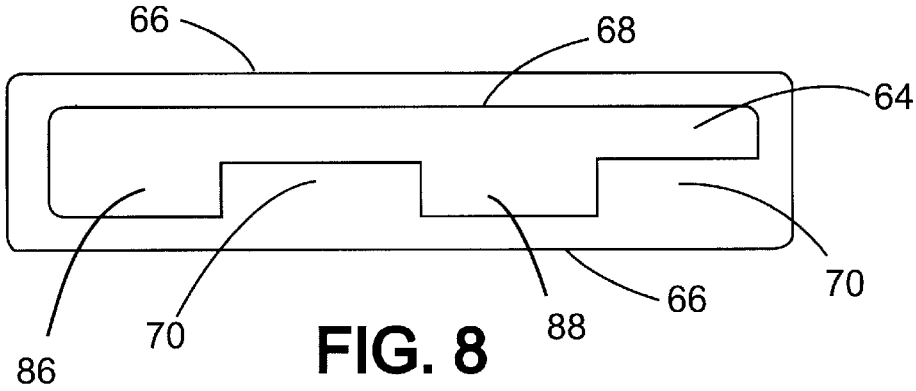
FIG. 8 is a top view of one possible structure for the first mating elements.
Figure 9:
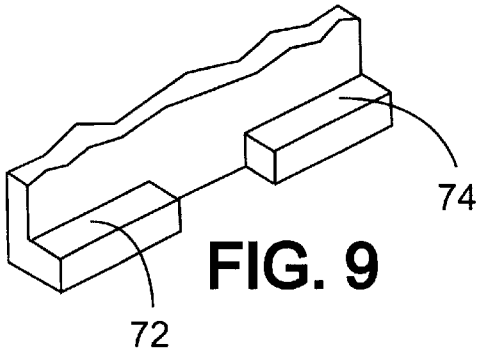
FIG. 9 is a perspective view for a possible structure for the second mating elements.

For safety's sake, deck components 20 through 30 are lockable to deck 12. Preferably, deck components 20 through 30 are key lockable to deck 12. FIGS. 8, 9, 10 and 11, provide an example of one possible set of structures for first and second mating elements 18 and 32 along with a mechanism for locking deck components to a deck. FIG. 8 shows a structure for first mating elements 18. The structure consists of a recess 64 bounded by sidewalls 66 with upper edges 68 having alternating flanges 70 extending partially across recess 64. FIG. 9 shows a perspective view of one possible structure for second mating elements 32. The structure consists of projections in the form of L-shaped lugs 72 and 74. Looking back at FIG. 2, lugs 72 can be seen in side profile extending downwardly from bait preparation station 40. Looking back at FIG. 3, lugs 74 can be seen in side profile extending downwardly from auxiliary fuel tank 54. Looking back at FIG. 4, lugs 72 and 74 can be seen in front profile extending downwardly from storage box 62.

Whenever a deck component is secured to deck 12, lugs 72 and 74 are placed into recess 64 through slots 86 and 88. Once lugs 72 and 74 are inside recess 64, the attached deck component is translated in a direction that urges lugs 72 and 74 under flanges 70. As long as lugs 72 and 74 are under flanges 70, the attached deck component is held fast to deck 12.

Figure 10:
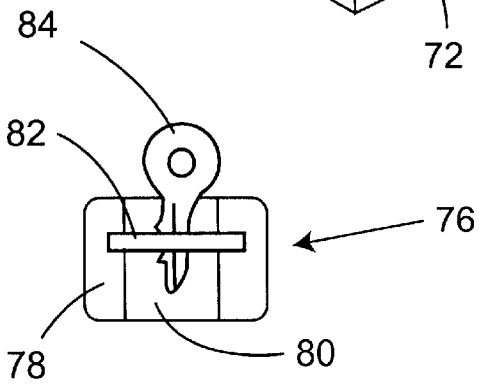
FIG. 10 is a side view of a locking mechanism used to lock the first and second mating elements together.
Figure 11:
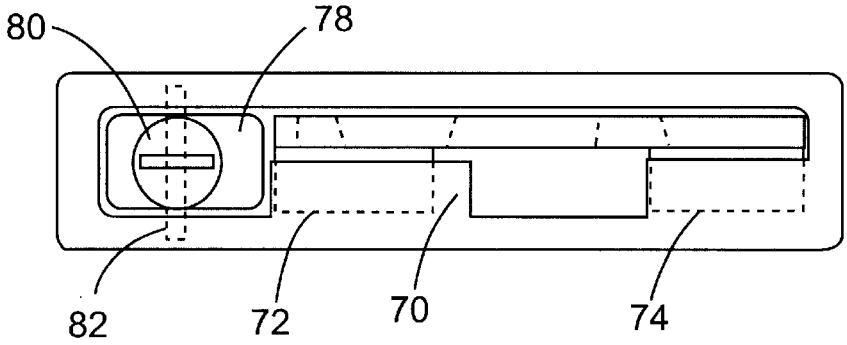
FIG. 11 is a top view showing the second mating element of FIG. 9 locked to the first mating element of FIG. 8.

FIG. 10 shows a locking mechanism 76 used to prevent lugs 72 and 74 from moving from under flanges 70 while the attached deck component is in use. Locking mechanism 76 is made up of a lock housing 78 that includes a lock cylinder 80 in mechanical communication with locking bar 82. A key 84 unique to boat 10 is used to turn lock cylinder 80 to urge locking bar 82 into locked and unlocked positions. Lock housing 78 is sized to take up the empty space of slot 86 whenever lugs 72 and 74 are under flanges 70. Lugs 72 and 74 are locked under flanges 70 by first placing lock housing 78 into the empty space of slot 86 and, second by using key 84 to turn lock cylinder 80 to urge locking bar 82 into its locked position engaging sidewalls 66. It is important to note that many other structures are available for first mating elements 18 and second mating elements 32.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An adaptable, multi-purpose boat having a longitudinal axis and a transverse axis, said boat comprising:

a) a generally planar boat deck having middle, fore, aft, port and starboard sections;

b) a plurality of first mating elements disposed in a first predetermined pattern on said boat deck; and c) a plurality of deck components each having at least one second mating element attachable to at least one of said first mating elements, wherein at least one of said deck components has a base dimensioned to allow two or more of said second mating elements to be aligned and spaced to match the alignment and spacing of predetermined multiples of said first mating elements and whereby said deck components are removably attachable to said boat deck in different configurations.

2. The boat of claim 1, wherein the total number of said first mating elements exceeds the number of said second mating elements.

3. The boat of claim 1, wherein said predetermined pattern is a rectangular array having columns and rows aligned with said longitudinal and transverse axes.

4. The boat of claim 1, wherein said deck components are selected from the group consisting of seats, chairs, storage boxes, bait preparation station, and steering consoles.

5. The boat of claim 1, wherein said boat deck further includes a plurality of utility attachment points disposed on said boat deck in a second predetermined pattern.

6. The boat of claim 5, wherein said utility attachment points include connectors for standard marine wiring, electric control cables and drain pipes.

7. The boat of claim 1, wherein said first mating elements and second mating elements are lockable to one another.

8. The boat of claim 7, wherein said first and second mating elements are key lockable.

9. An adaptable, multi-purpose boat having a longitudinal axis and a transverse axis, said boat comprising:

a) a generally planar boat deck having middle, fore, aft, port and starboard sections;

b) a plurality of first mating elements disposed in a first predetermined pattern on said boat deck;

c) a plurality of deck components each having at least one second mating element attachable to at least one of said first mating elements, whereby said deck components are removably attachable to said boat deck in different configurations; and d) a plurality of utility attachment points disposed on said boat deck in a second predetermined pattern.

10. The boat of claim 9, wherein one of said mating elements are recesses and the other of said mating elements are projections.

11. The boat of claim 9, wherein one of said deck components is a steering console having a first electrical connector connectable to a second electrical connector belonging to at least one of said utility attachment points.

12. The boat of claim 9, wherein one of said deck components is a bait preparation station having a drain line connectable to a drain line connector belonging to at least one of said utility attachment points.

13. The boat of claim 9, wherein one of said deck components is an auxiliary fuel tank having a fuel line connectable to a fuel line extension belonging to at least one of said utility attachment points.

14. An adaptable, multi-purpose boat having a longitudinal axis and a transverse axis, said boat comprising:

a) a generally planar boat deck having middle, fore, aft, port and starboard sections;

b) a plurality of first mating elements disposed in a predetermined organized pattern on said boat deck;

c) a plurality of deck components each having at least one second mating element attachable to at least one of said first mating elements, said mating elements having recesses, and said second mating elements each having at least one projection insertable into said first mating element, whereby said deck components are removably attachable to said boat deck in different configurations; and d) a plurality of utility attachment points disposed on said boat deck in a second predetermined pattern.

15. The boat of claim 14, wherein each of said recesses are bounded by sidewalls with upper edges having alternating flanges extending partially across each of said recesses.

16. The boat of claim 15, further including a locking mechanism for each of said recesses.

17. The boat of claim 14, wherein each of said projections are L-shaped lugs.

18. The boat of claim 14, wherein said first and second predetermined patterns are rectangular arrays of equidistantly spaced columns and rows.

19. The boat of claim 14, wherein at least one of said deck components is an aftermarket accessory.

20. The boat of claim 14, wherein said recesses include protective covers.

* * * * *